US006712653B2

(12) United States Patent
Free

(10) Patent No.: US 6,712,653 B2
(45) Date of Patent: Mar. 30, 2004

(54) SELF-TENSIONING PEDAL DRIVE MECHANISM FOR A HUMAN POWERED BOAT

(75) Inventor: James Jacob Free, 23913 Eastgate Ave., Elkhart, IN (US) 46516

(73) Assignee: James Jacob Free, Elkhart, IN (US)

( * ) Notice: Subject to any disclaimer, the term of this patent is extended or adjusted under 35 U.S.C. 154(b) by 0 days.

(21) Appl. No.: 09/900,636

(22) Filed: Jul. 6, 2001

(65) Prior Publication Data

US 2003/0013355 A1 Jan. 16, 2003

(51) Int. Cl.[7] ..... B63H 16/20
(52) U.S. Cl. ..... 440/30; 440/27
(58) Field of Search ..... 440/21, 26, 27, 440/28, 29, 30, 31

(56) References Cited

U.S. PATENT DOCUMENTS

| | | | | | |
|---|---|---|---|---|---|
| 98,302 | A | * | 12/1869 | Ross | 440/29 |
| 397,282 | A | * | 2/1889 | Frenzel, Jr. | 440/29 |
| 621,465 | A | * | 3/1899 | Storms | 440/29 |
| 1,072,027 | A | * | 9/1913 | Mosteller | 440/29 |
| 1,411,540 | A | * | 4/1922 | Szafka | 440/29 |
| 1,701,381 | A | * | 2/1929 | Marangoni | 440/30 |
| 3,182,628 | A | * | 5/1965 | Avellino | 440/29 |
| 3,915,110 | A | * | 10/1975 | Benwell | 440/30 |
| 4,349,340 | A | * | 9/1982 | Hoffmann | 440/30 |
| 5,011,441 | A | | 4/1991 | Foley et al. | |
| 5,194,024 | A | * | 3/1993 | Shiraki | 440/29 |
| 5,362,264 | A | * | 11/1994 | Parant | 440/29 |
| 5,547,406 | A | * | 8/1996 | White | 440/12 |
| 5,580,288 | A | * | 12/1996 | Marinc | 440/29 |
| 5,651,706 | A | * | 7/1997 | Kasper | 440/29 |
| 5,672,080 | A | * | 9/1997 | Gauthier | 440/27 |
| 5,702,274 | A | * | 12/1997 | White | 440/21 |
| 6,146,218 | A | * | 11/2000 | White | 440/30 |
| 6,231,408 | B1 | * | 5/2001 | Lekhtman | 440/29 |

FOREIGN PATENT DOCUMENTS

| | | | | |
|---|---|---|---|---|
| AT | 10338 | * | 12/1902 | 440/29 |
| CH | 23067 | * | 12/1900 | 440/29 |
| DE | 2226178 | * | 12/1973 | 440/28 |
| FR | 1375350 | * | 9/1964 | 440/29 |
| JP | 07304494 A | * | 11/1995 | B63H/16/20 |
| JP | 09207886 A | * | 8/1997 | B63H/16/18 |

OTHER PUBLICATIONS

Abbott & Brooks, Human Powered Watercraft, Dec., 1986, Scientific American p. 34 published in USA.

* cited by examiner

*Primary Examiner*—S. Joseph Morano
*Assistant Examiner*—Ajay Vasudeva

(57) ABSTRACT

A pedal driven aquatic propulsion system comprises a driven sprocket located substantially vertically beneath a drive sprocket. The planes of rotation of the drive and driven sprockets are disposed substantially at right angles to one another. An endless chain drive transmits power from the drive sprocket to the driven sprocket, operating in a twisting three-dimensional orientation as it loops around the sprockets. A pivoting, self tensioning idler arm is adjustably mounted on a frame that encloses the propulsion drive, and comprises an idler sprocket disposed in rotatable contact with the chain drive to maintain the chain under constant tension. The plane of rotation of the idler sprocket is tilted and offset from the planes of rotation of the drive and driven sprockets. The constantly tensioning system comprises a series of stationary and flying idlers aligned to the natural twist of the chain.

21 Claims, 9 Drawing Sheets

SELF-TENSIONING PEDAL DRIVE MECHANISM FOR A HUMAN POWERED BOAT

STATEMENT REGARDING FEDERALLY SPONSORED RESEARCH AND DEVELOPMENT

Not applicable

BACKGROUND OF THE INVENTION

In inventing a propeller drive for a human powered boat, the initial impulse would be to use a rope or belt. Indeed, this approach has been picked up on in the development of human powered boat drive systems at least as far back as Victorian times as represented in 1869 with Ross (U.S. Pat. No. 98,302), 1889 with Frenzel (U.S. Pat. No. 397,282), as well as by others including Storms, (U.S. Pat. No. 621,465), Mosteller (U.S. Pat. No. 1,072,027), Szafka (U.S. Pat. No. 1,411,540), Avellino (U.S. Pat. No. 3,182,628), Shiraki (U.S. Pat. No. 5,194,024), Parant (U.S. Pat. No. 5,362,264), Avvocato (France 1,375,350), _Lackner (Germany 2,226,178) . The fact that even though a toothed belt may be used as in White (5,547,406 et el), Lekhtman (U.S. Pat. No. 6,231,408), Marinc (U.S. Pat. No. 5,580,288), et el, doesn't ease the condition of energy loss due to deforming soft material as it engages into and twists around a pulley. This type of system absorbs too much of the cyclist's energy to actuate it. Furthermore, in higher torque situations, ropes or belts will tend to slip. Toothed belts can be built large enough by those trained in the art to prevent slippage with medium-high torque propellers, but by the time this problem has been solved, he material deformation energy loss as the drive is actuated will have been way too high. This fact can be further proven in that although belts and toothed belts have been around for a long time, their use has still not caught on in bicycles.

In 1984, a pedal powered watercraft called the Flying Fish was the first known hydrofoil to achieve successful flight under human power (IHPVA, 1984). It had broken most national and international speed records from the 100 meter sprint to the 2000 meter (SCIENTIFIC AMERICAN, 1986). The strut and drive system consisted of a drive shaft in the plane of the pedal crank connected to a propeller shaft by a #25 or ¼ pitch chain twisted into a "mobius", and engaged to a driven propeller shaft sprocket below and whose plane of rotation was twisted a quarter turn away. Examples are also to be found in Hoffman 1982 (U.S. Pat. No. 4,349,340), Eide 1991 (U.S. Pat. No. 5,011,441), Parant 1994 (U.S. Pat. No. 5,362,264), et el.

Due to the fact that the Flying Fish chain was operated near its breaking point, it spun easily, but could only be used in racing. Also the Flying Fish type setup used secondary shafting which means two or more chains. Other prior art which also includes the use of secondary shafts is exemplified in Marangoni (U.S. Pat. No. 1,701,381), Maranic (U.S. Pat. No. 5,580,288), White (U.S. Pat. No. 5,547,406, et el), Kasper (U.S. Pat. No. 5,651,706), Grundner (Swiss 23,067), (Germany 10,338) et el. Although this characteristic allows for easy pulley diameter/gear ratio change adaptation, it is heavier, more complex because of more moving parts, requires extra power to operate the extra shaft, chain/belt and bearings, and is extremely difficult to maintain the tension of both or more belts or chains.

Although Eide (U.S. Pat. No. 5,011,441), et el simplify the drive over those using secondary shafting to the use of just two shafts, reliability problems were present due to derailing and/or chain breakage. Although the drive unit of Eide et el would provide chain operation with low power loss in a twisted environment, it would often prematurely break due to the chain not being heavy duty enough as well as operating in a continually loosening or loosening and sometimes tightening situation. For those and other reasons, chains, and ultimately sprockets would wear out faster.

Attempts to solve the problem of chain tensioning included drive units with adjustable fixed idler systems that could be unbolted, relocated, then retightened. These attempts started in the human powered boat racing efforts of this inventor pre-1992; Bill Murphy, Paul Niedermann, Warren Beauchaump, Bob Buerger pre-1998, et el, and an example is to be found in Gauthier (U.S. Pat. No. 5,672,080)

In a non constantly tensioned system, if a single bolted idler or jack shaft were to get repositioned, or if the drive system was to experience a chain which lengthens, the system will jam, skip or undergo teething problems. Chains lengthen or 'stretch ' due to initial breaking in, temperature changes, wear, etc. A constant vigil must therefore be kept on anything other than self-tensioning drive in order for the system to work properly.

SUMMARY OF THE INVENTION INCLUDING OBJECTS OF THE INVENTION

Newer type bicycle chains (#43; ½ k pitch) are currently available on the market that lend themselves to being operated while twisted. There are now available full size bicycle chain types that can be twisted 90 degrees over a distance of some 18 inches or less. This development allows full size chain to be used in struts almost as narrow as they would need to be for the thinner lighter duty chain. Bicycle chain has 2 to 2.5 times larger tensile strength than #25

It is absolutely essential that the drive unit be able to provide the MOST TORQUE POSSIBLE with the LEAST OPERATIONAL DRAG POSSIBLE.

If propellers were analyzed for drag where they do the most lifting, (average=0.8×[propeller tip diameter]) it would be found that the faster the rotational velocity, the more drag there is. The extreme would be where there's infinite velocity, no advance, and therefore infinite surface drag. This is due to the increased surface friction of the higher revving propellers, and is arrived at by the equation:

$$Fd = Cd\left(\frac{1}{2}\right)\rho V^2 S$$

where Fd=drag; Cd=drag coefficient [constant]; [½ ρ cancels out near the water surface] ρ is density (½ ρ cancels out near the water surface in English units); and note here: V=velocity and its squared!; S=surface area.

On blade angles, the formula that applies is $$V(final) = \frac{V(boat)}{\sin(\beta)}$$

where V(final)=blade velocity, V(boat)=boat velocity; B=blade angle at a particular diameter. Suffice it to say that the lesser angle B is, the faster the blade element has to go in order to get the same advance.

The full proof is very long, but the general idea is that when the velocity increases, drag force increases to the square!

Therefore, slower turning propellers with higher pitch to diameter ratios have less drag, but the bad news is that they have increased torque. The extreme is where there's zero velocity, infinite advance, and, of course, infinite torque.

My invention is the first hydrodynamically low drag daggerboard type drive that is intended for use with regular size bicycle chain. It can withstand two and a half times as much torque as those units that employ #45 ¼ inch pitch chain.

Concerning dependability, a user of a pedal powered drive unit will want to spend as little time as possible fixing, tinkering and adjusting the unit and the most time pedaling out on the water. My invention promotes this in that it is the first pedal powered drive that has a self-tensioner; in other words, as the length of the chain varies, the tensioner ADAPTS to it! The tensioner keeps the chain under tension regardless of its length. Chains will stretch due to eventual wear, but more likely because of factors like frictional heat, even temperature change. My invention solves the reliability problem by constantly tensioning the chain in a way somewhat similar to a regular rear-wheeled-tensioned multi speed bicycle, except in three dimensions instead of substantially two.

In order to prevent the chain from derailing (as well as have the lowest drag as possible), idlers must each be parallel to the pivot plane of the chain, perpendicular to path of the chain pin/roller axis. Therefore, in a twisted chain drive, they must be tilted the same degree as the twist. The leeward idlers in this invention are all matched up to the twist in three dimensions, and each idler and sprocket is surrounded by guide plates to further prevent derailing.

Therefore, It is the object of this invention to provide a rugged durable lightweight compact human powered boat drive system that lends itself to installation as a kick-up daggerboard, that lends itself to a multihull installation, an economical installation, a high performance installation, an integrated human powered hydrofoil strut installation, a high torque (large propeller pitch) installation, or any combination of the above.

It is another object of this invention to provide a self-tensioning drive system wherein it requires less adjustment, maintenance, It is another object of this invention to provide a drive system that can be framed in as a one-piece jacket that supports the pedal crank bracket and hardware in an accessible fashion above the waterline, and houses the propeller shaft mount, chainpath, internally in a smooth faired streamlined case below the water.

It is further an object of this invention to provide a drive system that is entirely maintenance free, and wherein the entire drive system lends itself to being totally waterproof wherein the interior workings may be non-corrosion-resistant, and therefore of lesser expense.

It is another object of this invention to provide a drive with a narrower strut, and therefore faster speeds.

Other objects of this invention will become obvious upon further examination.

DESCRIPTION OF A PREFERRED EMBODIMENT

Figure 1:
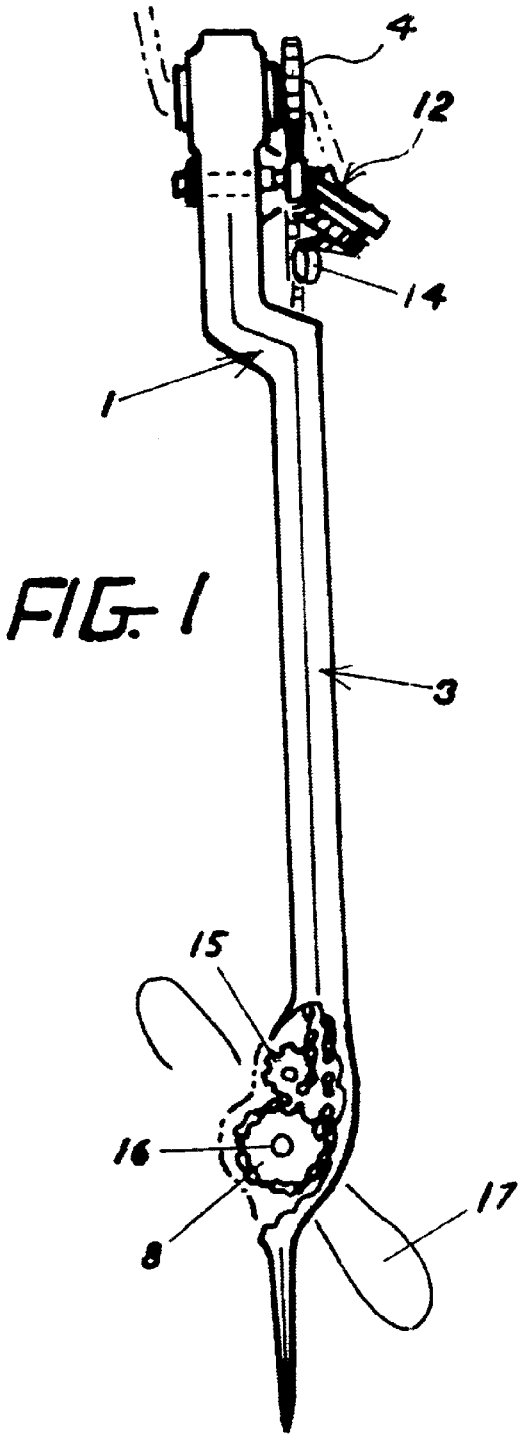
FIG. 1 shows a forward view of the mechanism including a cut away view of the shaft and idler sprockets.

The following preferred embodiment and alternative embodiments are put fourth to give an idea of the invention, but by no means do they represent the only form this invention would take.

A pedal-powered drive mechanism supported by frame and jacket 1 in [FIG. 1] has streamlined sections 2 in [FIG. 3 and 4] for the strut region below the waterline 3. The drive sprocket 4 in [FIG. 2] is driven by pedals 5 which pulls tensioned chain 6 through a narrow tube/passageway 7 encased within said strut region 3 from driven sprocket 8. The leeward non tensioned chain 9 is fed from said drive sprocket 4 through upper positioning idler 10 out again to upper tensioning arm idler 11. Said leeward chain 9 proceeds through assembly of idler arm 12 in an outward protruding plane to lower tension arm idler 13, then back to lower positioning idler 14. Said chain 9 progressing through idlers 10, 11, 13, 14 is kept from derailing by washers and retaining plate means (not shown).

Said leeward non tensioned chain 9 then continues down through said narrow tube/passageway 7. The driven sprocket positioning idler 15 in [FIGS. 1 and 3] receives said leeward chain 9 in a close proximity to said tension chain 6 and feeds it to the circumferential perimeter of driven sprocket 8. The propeller shaft 16 supports the propeller 17. Access to said propeller shaft 16, propeller shaft keeper bearings 18 in [FIG. 3], and driven sprocket 8, both sprocket 8 and idler 15 preventing derailment by washer and guide plate means 42 and 43 are covered by waterproof access cover 19. Said propeller shaft 16 is kept waterproof by shaft—seal 20 in [FIG. 4].

Figure 2:
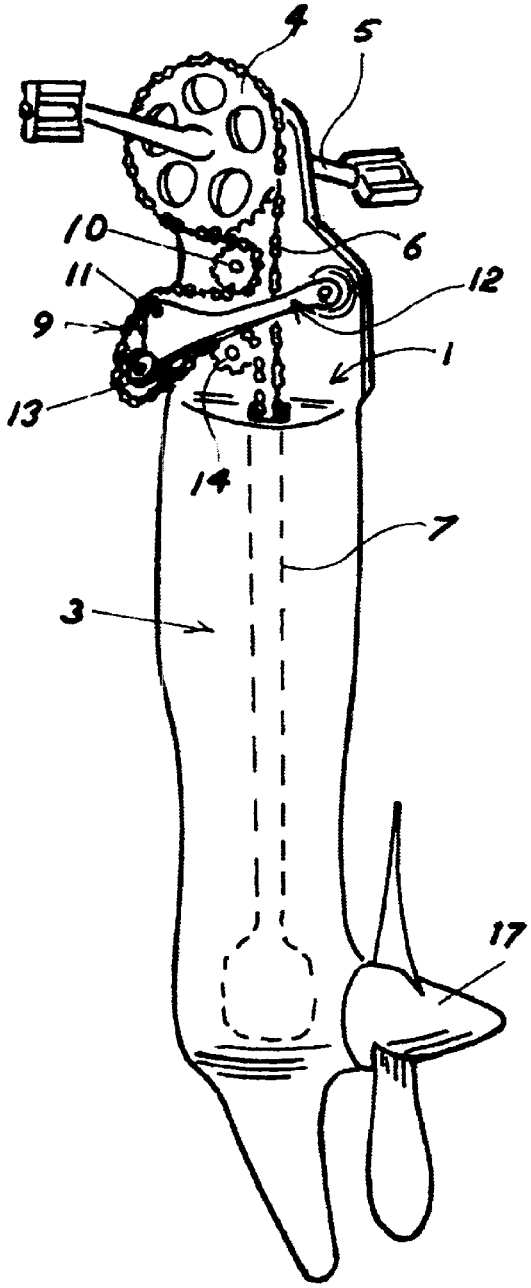
FIG. 2 shows a three-quarter aft view of the port side
Figure 3:
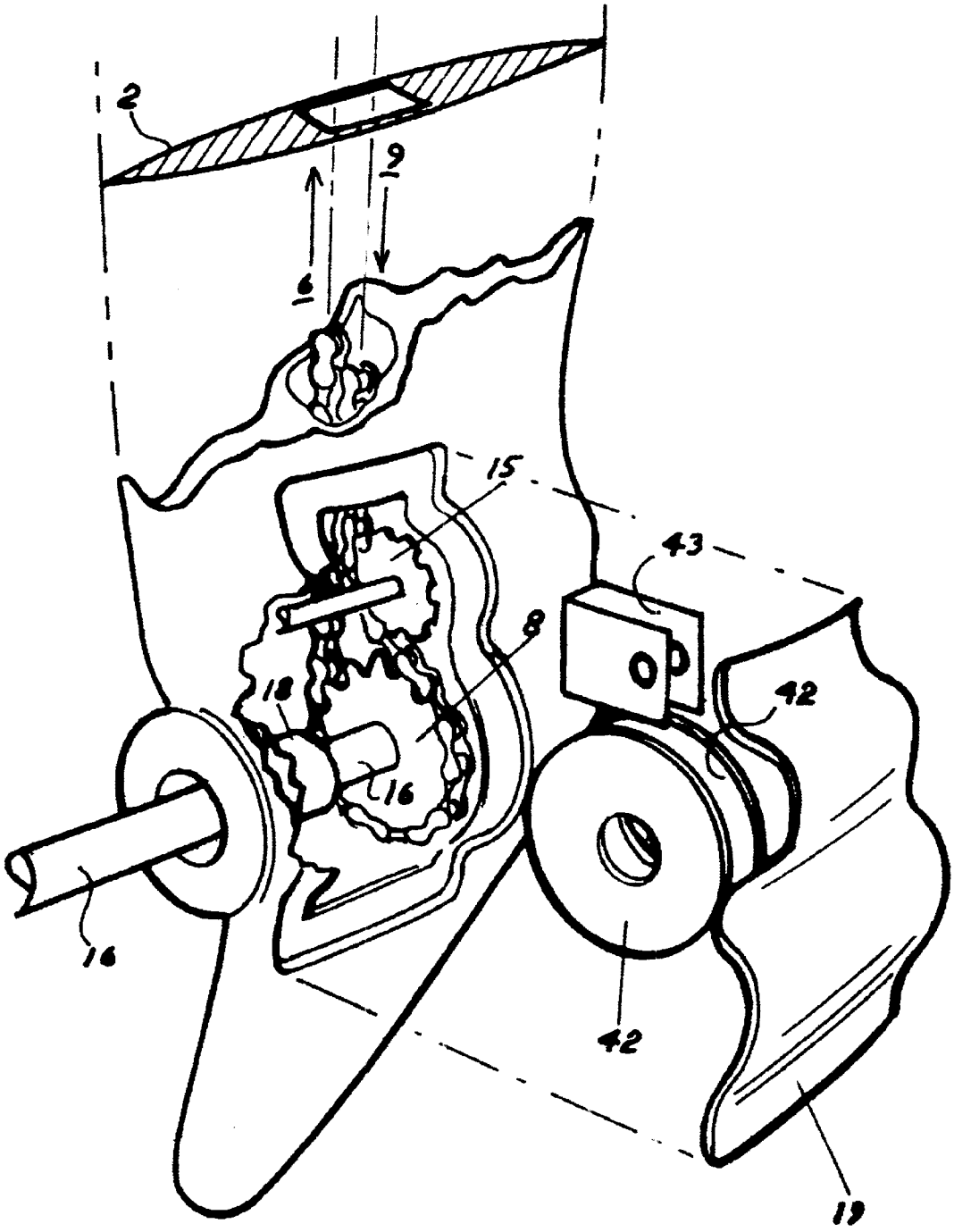
FIG. 3 shows details of the driven shaft assembly
Figure 4:
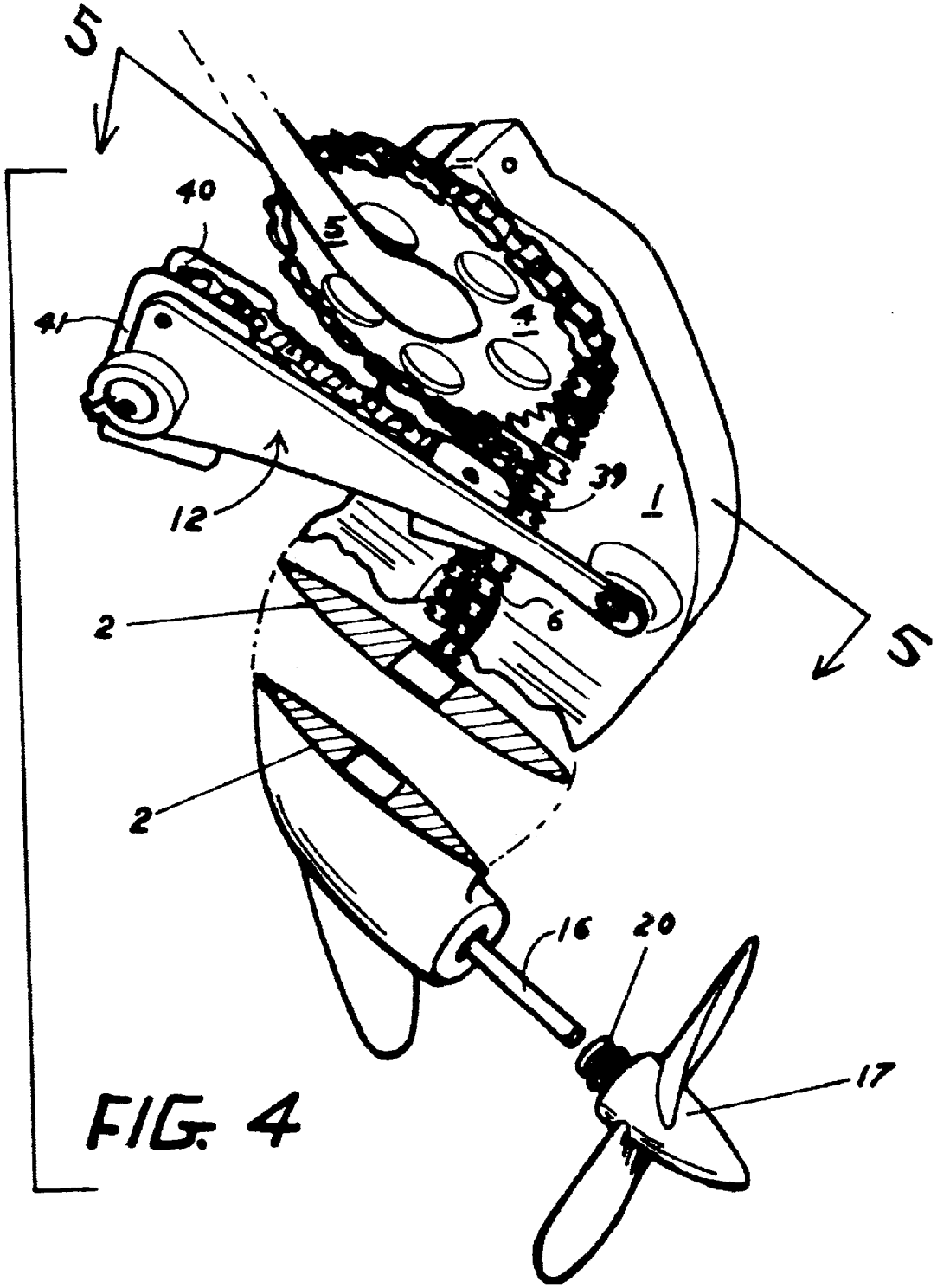
FIG. 4 shows the top three-quarter view of the whole drive unit
Figure 5:
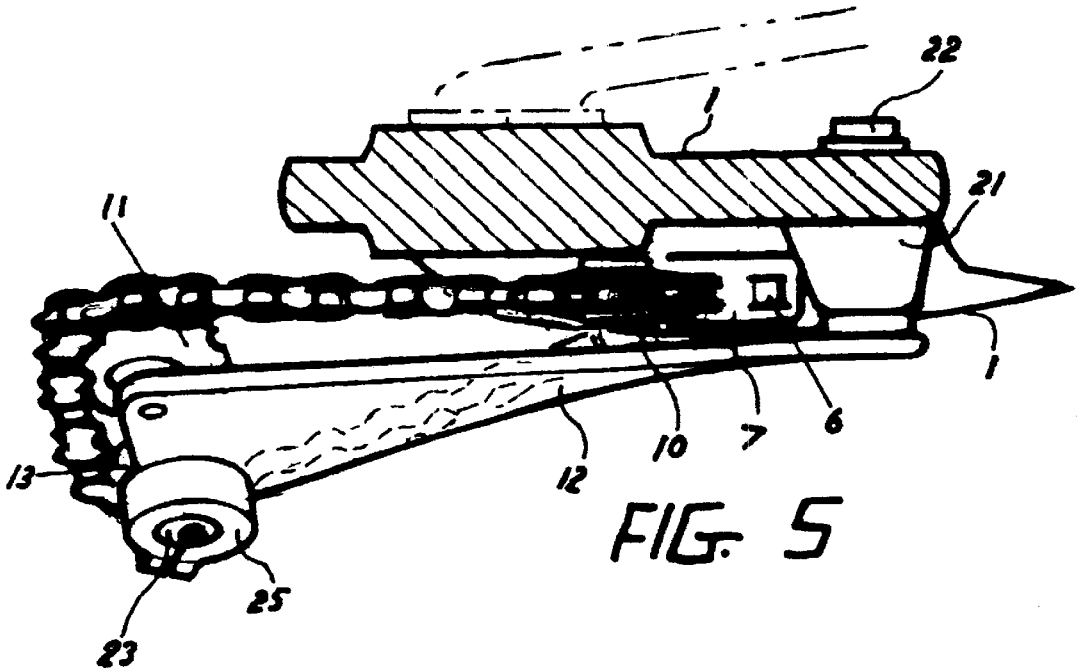
FIG. 5 shows the detail of the tensioner arm as assembled
Figure 6:
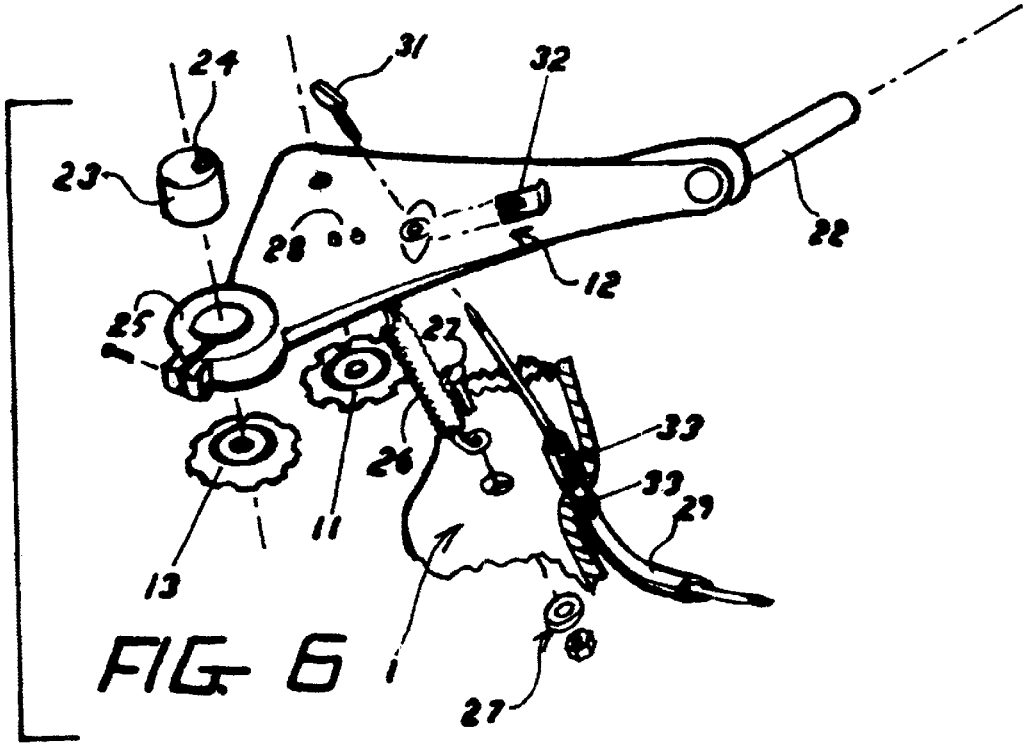
FIG. 6 shows an exploded view of the tensioner arm

The said tensioner arm 12 in [FIGS. 2 and 4] is supported from said frame 1 by a boss 21 in [FIG. 5] supporting around tensioner arm pivot pin 22 in (FIGS. 5 and 6] so that said tensioner arm 12 can swivel up and down. Adjustments to said leeward chain 9 can be made by rotating chain adjustment cylinder 23 in [FIGS. 5 and 6] so the lower idler mounting bolt hole 24 in [FIG. 6] can be repositioned enough to compensate for at least 2 chain link lengths. Said position of chain adjustment cylinder 23 is held tightly by the chain adjusting cylinder mount clamp 25. Said tensioner arm 12 is pulled towards said frame 1 by a spring means 26 bolted to said frame 1 by fastener 27 and hooked to said tensioner arm 12 through guide holes 28. Chain skipping or "teething" caused by propeller reversal, stops, etc., can be compensated for by squeezing a hand brake (not shown) which actuates push cable 29, pulling in said tensioner arm 12 by means of cable with swaging 31 secured to said arm 12, thereby increasing tension. Said cable and swaging 31 is secured to said tensioner arm 12 by fastener means 32. Push cable is secured to said frame 1 by means of fastener 33.

In order to accommodate drive sprockets of different sizes, and thus change the gear ratio, the position of the pedal axis is changeable while not affecting the tangential relationship of said tensioned chain 6 with said drive sprocket 4 and said driven sprocket 8 proceeding through said narrow tube/passageway 7. A cylindrical sleeve 35 in [FIG. 7] has outside diameter to match inside diameter of clamping ring 36 which integrates into said upper frame 1, and has a single axial wall split 37. Said cylindrical sleeve 35 has substantially eccentric (non concentric) inner and outer diameters while their center lines are parallel. The inner diameter of said sleeve 35 is the same as and accommodates the outer diameter of the pedal bracket shell 38 which supports a standard pedal bracket cartridge (not shown).

Figure 8:
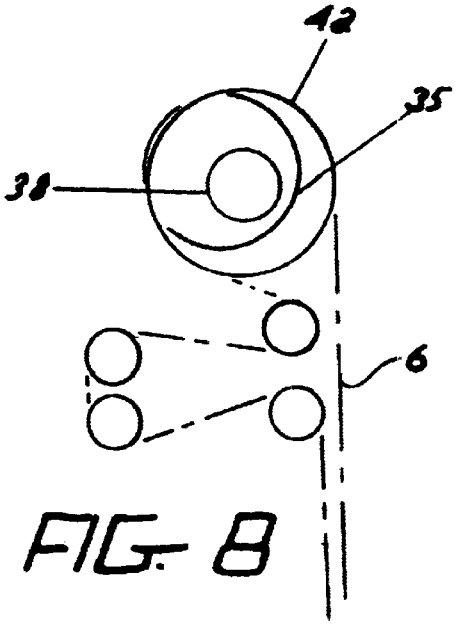
FIGS. 8 and 9 shows the two extreme positions of the adjustment
Figure 9:
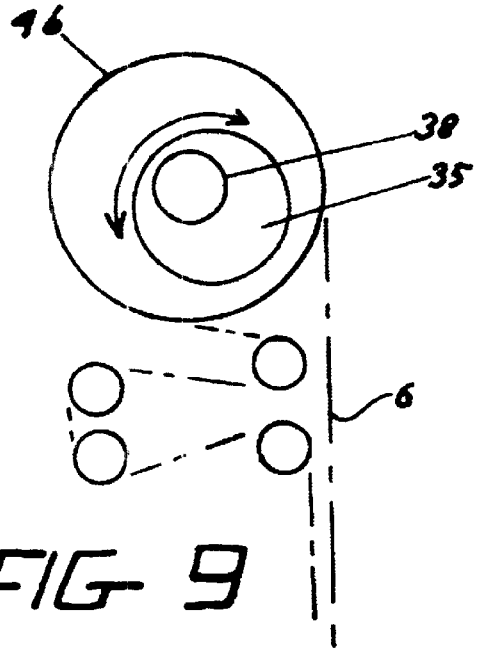

Adjustment for a small sprocket 4a in [FIG. 8] has said cylinder 35 rotated such that said pedal bracket shell 38 is close to the centerline of said tensioned chain 6, while for large sprocket 4*b* in [FIG. 9], said cylindrical sleeve 35 is rotated such that said bracket shell 38 is further away from said tensioned chain 6 centerline. Said leeward non tensioned chain 9 in [FIG. 10] is kept from derailing between said drive sprocket 4 and said tensioner arm 12, as well as between said arm 12 and driven sprocket 8 in [FIG. 11] , by plate means 39 mounted over said upper and lower positioning idlers 10 and 14 to said frame 1. Derailment of said chain 9 progressing through upper and lower tensioning arm idlers 11 and 13 on said tensioner arm 12, is prevented by inner and outer plate means 40 and 41. Derailment from said driven sprocket 8 and said driven sprocket positioning idler 15 in [FIGS. 3 and 11] is performed by washer means 42 and guide plate means 43.

PREFERRED OPERATION

Figure 10:
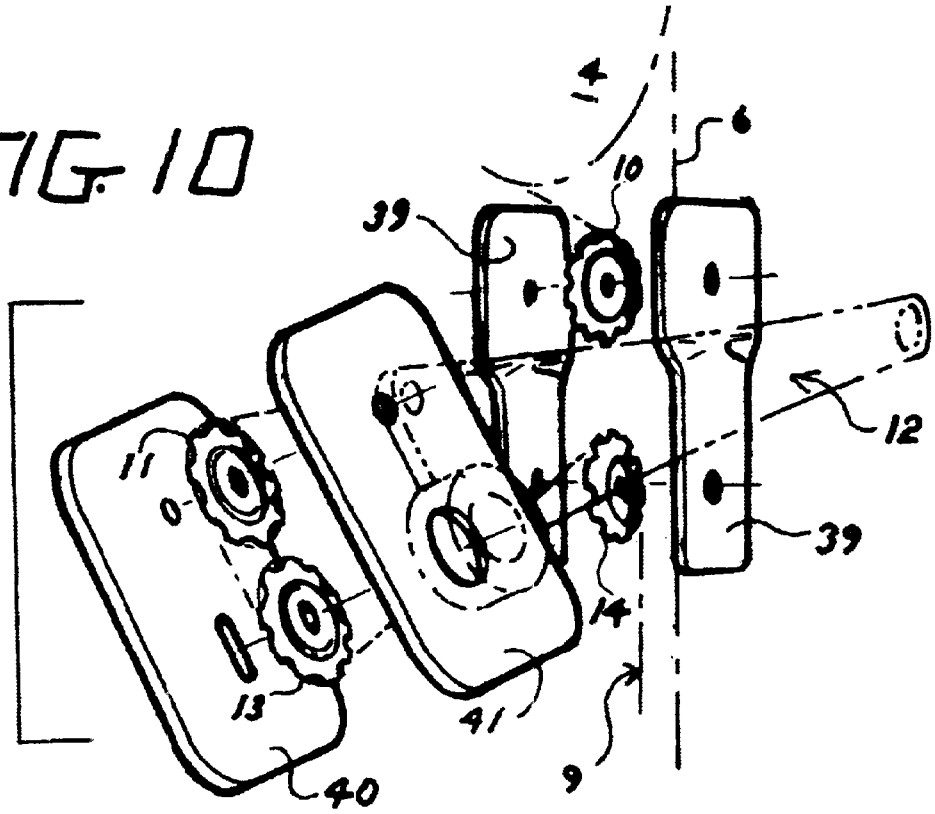
FIG. 10 shows the anti-derailment guide plates on the tensioner arm and upper stationary idlers
Figure 11:
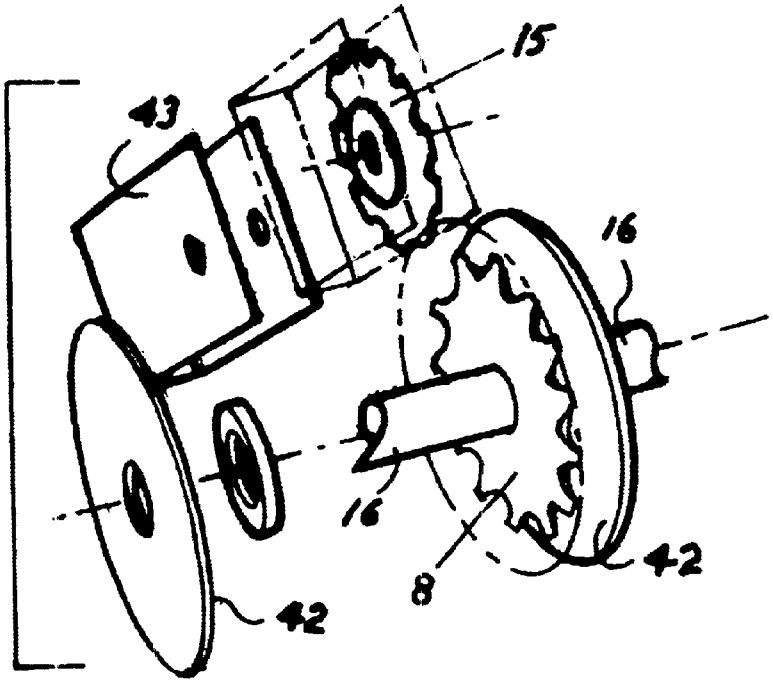
FIG. 11 shows the guide plates around the driven sprocket and idler
Figure 12:
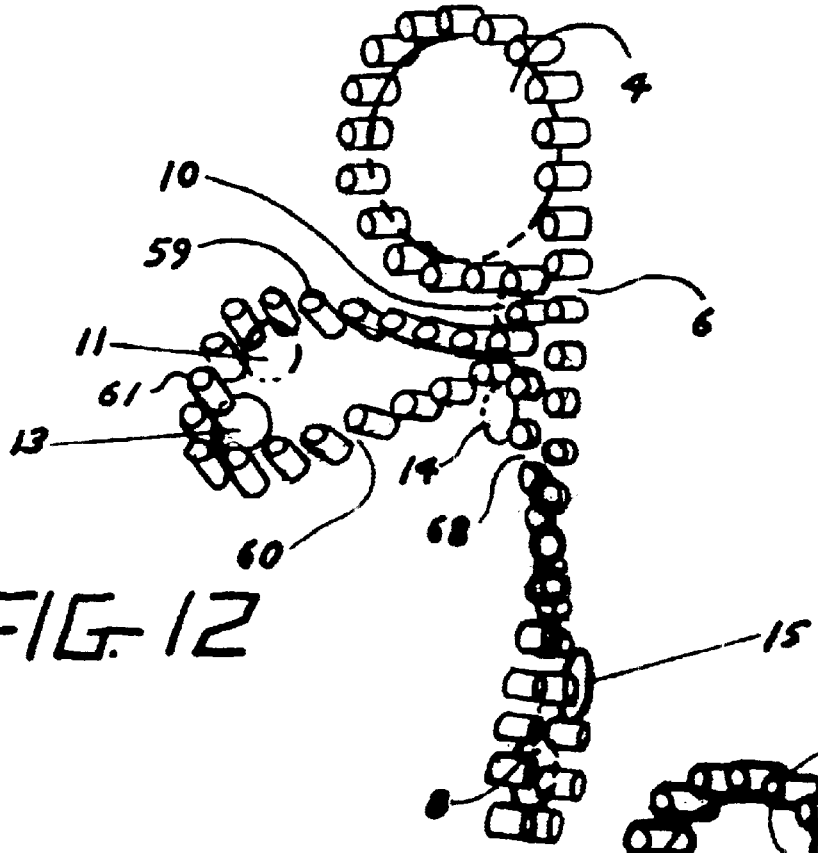
FIG. 12 shows a perspective view of a reversal/opposite twisting figure-8 mobius orientation of the chain roller centers as they progress through the three dimensional chain path
Figure 13:
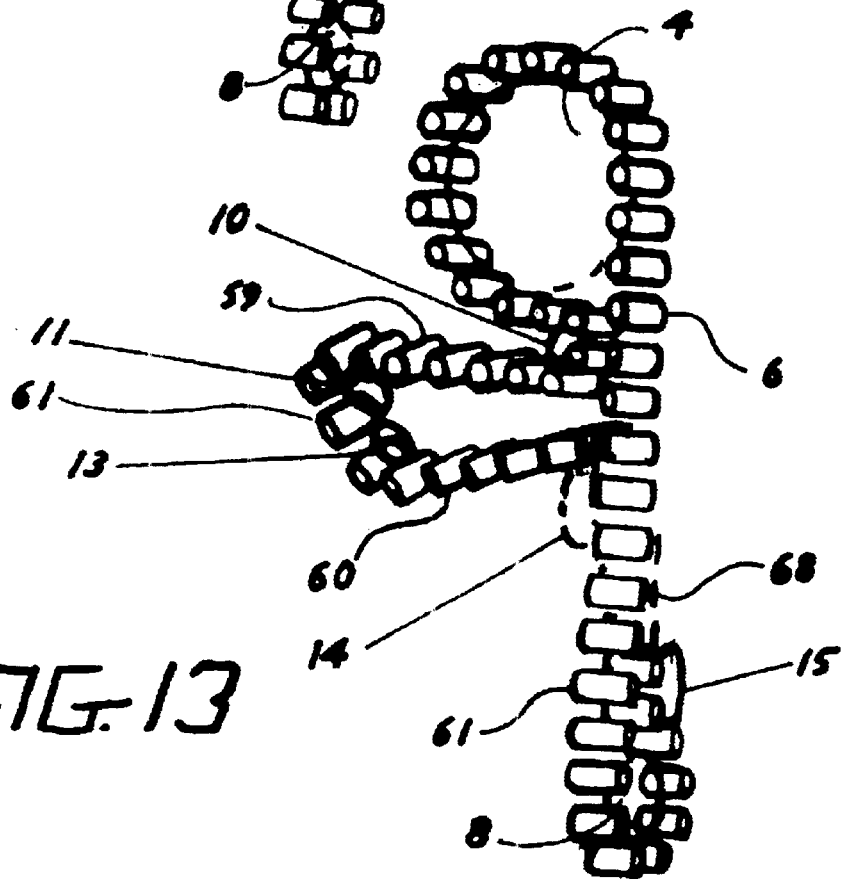
FIG. 13 shows a a perspective view of uniform twist where both axis of chain roller centers are the same as each other as they progress through the three dimensional chain path

As tension in tensioned chain 6 is caused by applying torque to the drive sprocket 4, the chain wraps around said drive sprocket 4 until it is fed to the leeward non tensioned region 9 in [FIG. 1 and 10]. Said leeward chain 9 is first fed through upper idler 10 and out to upper tension idler 11 in the same plane defined vertically by centerline 59 in [FIGS. 12 and 13] and said drive sprocket 4. Although this first leeward section of chain 59 continues to said upper tension arm sprocket 11 in the same plane as said centerline 59, and said drive sprocket 4, it twists between said idlers 10 and 11. After said chain 9 is fed through said upper tension arm idler 11, it is fed into another plane defined by the chain centerline 59 at the upper bound, and chain centerline 60 at the lower bound. Said centerline 59 is between idlers 10 and 11, and centerline 60 is between idlers 13 and 14. Chain in said centerline portions 59 and 60 is twisted; Chain in portion 61 between idlers 11 and 13 is not.

Figure 14:
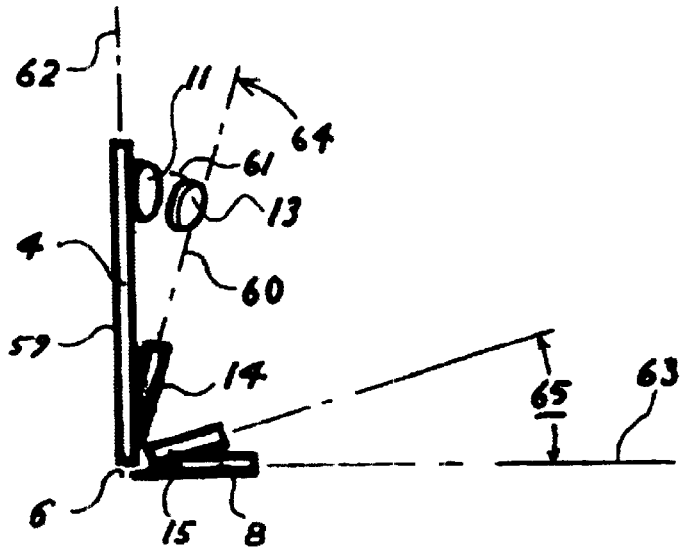
FIG. 14 shows a top view of the orientation of lower and upper idlers as well as those idlers in the tensioner arm oriented with respect to the drive and driven sprockets

Said idler 10 runs in the same plane as said drive sprocket 4. The plane of said idler 14 is aimed outward while the fed chain is as close as possible to being tangent to a common origin vertex of centerlines of 60 and 61 in [FIG. 12 and 13]. The degree to which this plane is angled is defined by the following formula:

$$\alpha = \frac{90x}{l}$$

where$\alpha$ is the angle from said drive sprocket plane 62 in [FIG. 14] (or the driven sprocket plane 63 depending on which origin is referred to), x is the distance from said idler centers of 14, and 15, to the center of said drive sprocket 4 (or said driven sprocket 8), l is the distance between said drive and driven sprockets 4 and 8.

The portion of chain centerline 60 is fed from said idler 13 to said idler 14. Said portion 60 is along said centerline 64 in [FIG. 14] and twists so that the chain centerline portion 68 in [FIG. 12 and 13] is heading substantially vertical after it is fed through said idler 14. Said leeward chain 9 twists as it travels through said center line portion 68 such that by the time it reaches said driven sprocket positioning idler 15. After being fed through said driven sprocket positioning idler 15, it is in a plane 90 degrees from plane of said drive sprocket 4. In order for said driven sprocket positioning idler 15 to be placed most optimally, it is slightly out of plane from said plane of driven sprocket 8, with its plane-twist-angle 65 in [FIG. 14] being defined by the above formula. After the chain follows around said driven sprocket 8, it completes a cycle and again becomes said tension portion 6 twisting 90 degrees between centerlines of said driven and drive sprockets 8 and 4.

ALTERNATIVE EMBODIMENT #1

Figure 15:
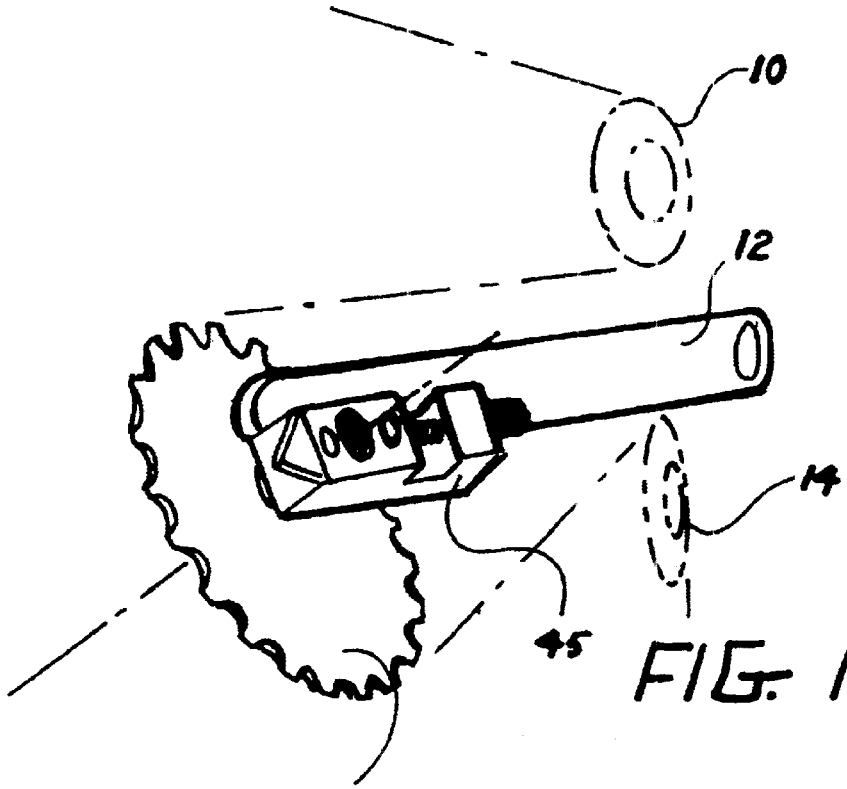
FIG. 15 shows an alternative embodiment of the tensioner arm assembly

An alternative Embodiment for the tensioner arm 12 in [FIG. 15] is where there is one large diameter idler 44 in lieu of idlers 11 and 13, and said tensioner arm 12 has one lug on it's end to fit said chain adjusting means 45.

ALTERNATIVE EMBODIMENT #2

Figure 16:
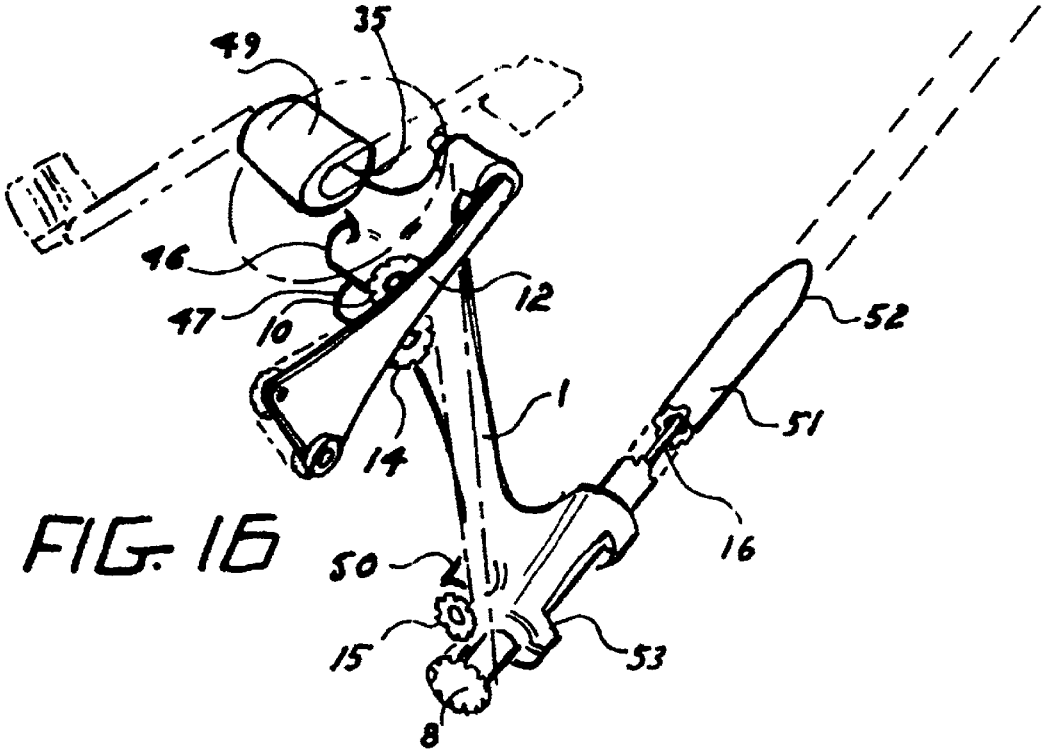
FIG. 16 shows an alternative embodiment of the drive unit with the chain path entirely external, and coordinated with a long shaft

Another alternative embodiment of this drive mechanism is where the frame 1 is a trunk in [FIG. 16] which supports the components entirely externally. Upper positioning idler 10 is supported by upper positioning idler boss 46. Lower positioning idler 14 is supported by lower positioning idler boss 47. Tensioner arm is supported by tensioner arm boss 48. Drive sprocket adjustment sleeve 35 is supported by adjustment sleeve boss 49. Driven sprocket positioning idler 15 is supported by driven sprocket positioning idler boss 50. The propeller shaft 16 is substantially long, and is held in place by an also substantially long keeper tube 51 and supported by occasional bushings (not shown). Said shaft and keeper descends past the waterline 52 in a gradual manner wherein there is low water resistance and only slight angle from the horizontal. Said keeper tube 51 is connected to said trunk frame 1 by clamping collars 53.

ALTERNATIVE EMBODIMENT #3

Figure 17:
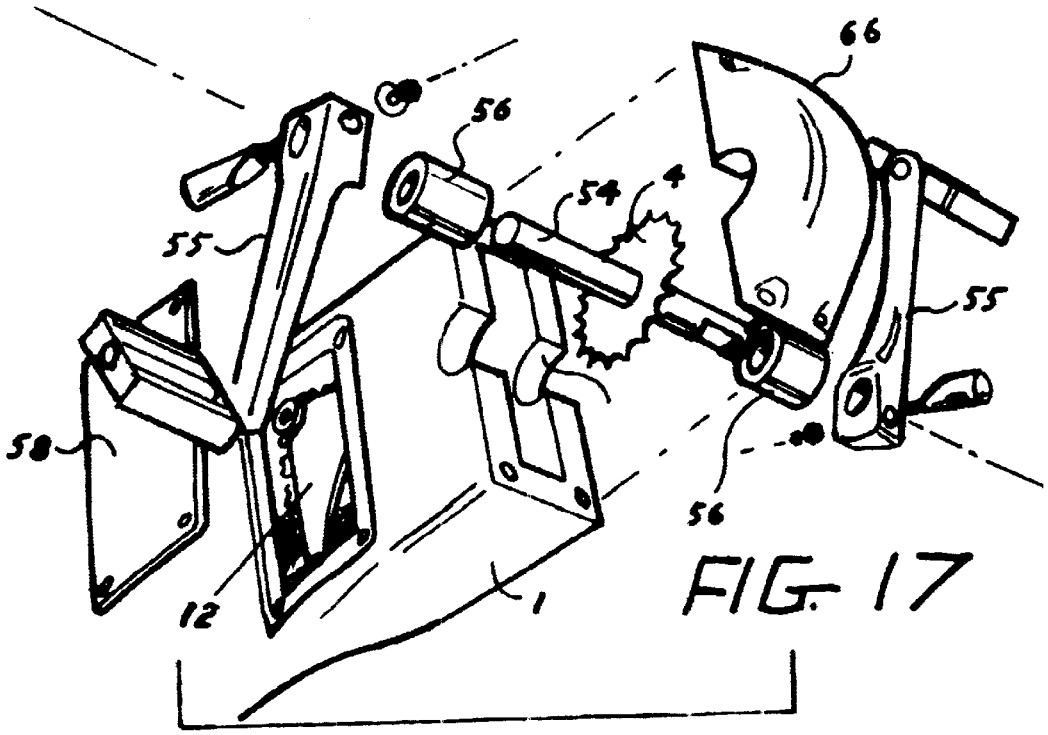
FIG. 17 shows an alternative embodiment wherein the chain and tensioning components are contained entirely within in a waterproof casing.

Still another alternative embodiment consists of the frame and jacket 1 in [FIG. 17] entirely encapsulating the components such that the drive mechanism is waterproof. A drive shaft 54 is driven by taper-pinned-pedals 55, with the drive sprocket 4 affixed in center of said shaft 54. Said shaft 54 is supported by water-sealed bearings 56 which rest in grooves 57. A water sealed cap 66 mounts said bearings 56 in place while keeping the resulting parting line watertight. Access to the tensioner arm 12 and the rest of the upper components is kept watertight by waterproof access cover 58.

ALTERNATIVE EMBODIMENT #4

Figure 7:
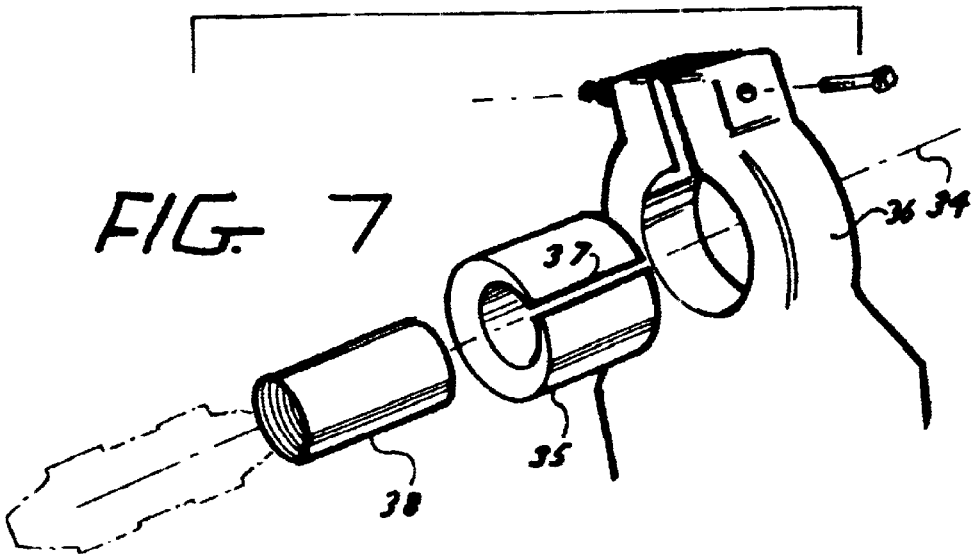
FIG. 7 shows the detail of the drive sprocket size-adjustment-sleeve

An Alternative embodiment for said sleeve 35 in [FIG. 7] and/or water sealed bearings 56 and grooves 57 in [FIG. 17] is where the sleeve is graduated or mechanically indexed to mark the optimum sprocket positions, or the water sealed bearing package is faceted to insure bearing alignment of each side when different size sprocket/shaft assemblies are installed

ALTERNATIVE EMBODIMENT #5

To further prevent skipping or teething while coasting, or when the drive is pedaled in reverse, a ratchet and prawl-like freewheeling device can be installed in concert with or in lieu of the system with the handbrake, push cable 29, and swaged cable 31 in [FIG. 6].

I claim:

1. A pedal driven aquatic propulsion system of a boat comprising:

a drive frame with means to support and journal a pedal axle assembly operatively connected to a drive sprocket, a mounting bracket integrally formed with the drive frame to mount the propulsion system to a boat frame;

a propeller shaft operatively connecting a propeller to a driven sprocket, the driven sprocket located substantially vertically beneath the drive sprocket, wherein the respective axes of rotation of the drive and driven sprockets are skewed relative to each other, and planes of rotation of the drive and driven sprockets are disposed substantially at right angles to one another;

an endless chain drive operatively connecting the sprockets to transmit power from the drive sprocket to the driven sprocket, the chain drive operating in a twisting three-dimensional orientation as it loops around the sprockets;

and a pivoting self tensioning means comprising an idler arm is adjustably mounted on the frame, the idler arm further comprising at least one idler sprocket disposed in rotatable contact with the chain drive to maintain the chain under constant tension to compensate for the changing circumference length of the chain caused by at least the reasons related to heat or wear, the at least one idler sprocket having a plane of rotation that is offset from the planes of rotation of the drive and driven sprockets, wherein the self tensioning means is self actuated.

2. The aquatic propulsion system of claim 1 wherein the drive sprocket is supported between bearings.

3. The aquatic propulsion system of claim 2 wherein the bearings are kept aligned from side to side in a corresponding set-pattern condition by splines, keys, facets, or segment molding, wherein misaligned installation is prevented, the bearing center lines are automatically aligned, and the plane of rotation of the drive sprocket remains the same regardless of the different positions of drive sprockets of varying size.

4. The aquatic propulsion system of claim 1, wherein the self tensioning idler arm comprises a second idler sprocket disposed in rotatable contact with the chain drive to maintain the chain under constant tension, the second idler sprocket having a plane of rotation that is offset from the planes of rotation of the drive and driven sprockets.

5. The aquatic propulsion system of claim 1, wherein the drive frame comprises an upper casing and a lower streamlined casing, wherein portions of the chain drive going into the driven sprocket and coming from the driven sprocket are fed through an opening through the lower casing, the lower casing being offset with respect to the upper casing such that the centerline of the portion of the chain drive under tension is aligned with the incoming tangent of the drive sprocket and the outgoing tangent of the driven sprocket, while the drive sprocket is held overhung, and the centerline of the chain drive under tension is defined by the intersection of the planes of rotation of the drive and driven sprockets while the chain drive under tension is twisted between the drive sprocket and driven sprocket; and an upper idling means and a bottom idling means set respectively above and below the opening of the lower casing wherein the entering and exiting centerlines of the chain drive are positioned in close proximity.

6. The aquatic propulsion system of claim 5, wherein each casing of the drive frame comprises watertight enclosures with covers for access within the drive frame and to preclude water entry within the casings.

7. The aquatic propulsion system of claim 5, wherein the upper idling means comprises a first upper fixed idler and a second lower fixed idler fixedly attached to the upper casing of the drive frame such that the chain drive wraps around the drive sprocket, wraps around the first upper fixed idler, sends chain drive out the idler arm, through the idler sprocket of the idler arm, back in again, around the second lower fixed idler, and down through the opening through lower casing of the frame drive, the planes of rotation of drive sprocket and first upper fixed idler being the same, wherein the centerline of the portion of chain sent out the idler arm between the first upper fixed idler, and idler sprocket on self tensioning arm is substantially in the plane of rotation of the drive sprocket while the chain drive therein twists, wherein the plane of rotation of the second lower fixed idler is offset from the planes of rotation of the drive and driven sprockets while substantially intersecting with the planes of the drive and driven sprockets at the location of the centerline of the portion of the chain drive going into the drive sprocket and coming from the driven sprocket, wherein plane of rotation of idler sprocket on self tensioning arm has a large amount of offset or tilt with respect to the drive sprocket, wherein the degree of tilt of plane of rotation of the idler sprocket on the self tensioning arm is determined by the offset angle of the second lower fixed idler to align the centerline of the chain drive between the idler sprocket and the second lower fixed idler to the two tangents while chain drive therein twists, wherein the degree of said offset of the plane of rotation of the second lower fixed idler from the planes of rotation of the drive and driven sprockets is determined by the amount of natural twist in the portion of chain drive at the particular location of the second lower fixed idler between the drive and driven sprockets.

8. The aquatic propulsion system of claim 7 wherein the self tensioning idler arm is pivotable about a pivot axle pin, wherein the pivot axle pin is mounted to the upper casing of the drive frame, wherein the pivot axle pin is tilted slightly with respect to the axis of rotation of the drive sprocket toward the axis of rotation of the second lower fixed idler wherein the translation of the self tensioning idler arm about the pivot axle pin axis provides a balance between slight misalignments of drive chain going out the idler arm and coming in from it, wherein idler sprocket center is located slightly away from a reference line intersecting through pivot axle pin axis and perpendicular to first upper fixed idler and second lower fixed idler wherein when idler arm pivots further away from that reference line, increased tension will result.

9. The aquatic propulsion system of claim 8 wherein the bottom idler means comprises a bottom idler fixedly attached below the opening of the lower casing, the bottom idler being slightly tilted with respect to the plane of rotation of the driven sprocket, wherein the degree of such tilt is determined by the location of the bottom idler between the driven sprocket and the drive sprocket, wherein the plane of rotation of the bottom idler substantially intersects with the planes of the driven sprocket and the drive sprocket at the location of the centerline of the portion of chain drive coming out of the driven sprocket and going in to the drive sprocket wherein the driven sprocket is located immediately below the bottom idler, and wherein the drive chain wraps around the driven sprocket from the bottom idler to the tangent of the tensioned portion going back up to the drive sprocket.

10. The aquatic propulsion system of claim 7, further including guide or guard plates surrounding both sides of all idlers, inaccessible paths, and driven sprocket, wherein chain drive is guided back onto respective idlers or sprockets in the event of derailment, skipping or teething.

11. The aquatic propulsion system of claim 1, wherein the tension in the chain drive is actuated substantially by one or a combination of a force of gravity and a spring means.

12. The aquatic propulsion system of claim 1, wherein the changing perimeter length of the chain drive can be compensated for by adjustments to the idler sprocket on the tensioner arm, and wherein the self tensioning idler arm can be repositioned to provide tension on the chain drive.

13. The aquatic propulsion system of claim 12 wherein compensating adjustment for changing perimeter length of the chain drive is achieved either through rotation of a clamped sleeve with non-concentric inside and outside diameters wherein rotation of the sleeve adjusts the idler sprocket location on the self tensioning arm, or such compensating adjustment of the chain drive length is achieved by changing the location of bolt hole for idler sprocket on the self tensioning arm, or compensating adjustment of the chain drive length is achieved by a combination adjustment of bolt holes location and the rotatable clamped sleeve.

14. The aquatic propulsion system of claim 12, wherein a predetermined range of the pivot angle of the self tensioning idler arm can be established, wherein one extreme can be set to lower the operational drag of the propulsion system, and wherein the other extreme can be set to prevent the chain drive from skipping.

15. The aquatic propulsion system of claim 12 wherein the tension can be increased or decreased manually during operation, the one limit of extreme can be engaged to minimize power input, and the other limit can be actuated to engage the chain drive tightly when pedaled in reverse.

16. The aquatic propulsion system of claim 1, further including a freewheeling ratchet and prawl means wherein sudden stop or reversal of the pedals will not cause the chain drive to teeth, skip or derail from the sprockets and idlers.

17. The aquatic propulsion system of claim 1, including an axis repositioning means for the rotational axis of the pedal axle assembly, and wherein drive sprocket to driven sprocket gear ratios can be changed by engaging different sprocket sizes while still maintaining alignment of the tangents for the drive and driven sprockets through the opening in the streamlined lower casing.

18. The aquatic propulsion system of claim 17, wherein the pedal axle assembly is enclosed within a larger cylindrical sleeve having non-concentric inside and outside diameters while center lines of surfaces of said diameters are parallel, such that when the sleeve is rotated, the position of the pedal axle assembly is repositioned, while the plane of rotation of the drive sprocket remains unchanged;

wherein the position of the pedal axle assembly is adjusted by rotating the sleeve such that for smaller sprockets, position of said pedal axle assembly is close to the tangent where the incoming chain intersects; and for larger sprockets it is farther away while the tangent point stays in the same place;

and wherein the sleeve is held in place by a clamp around its outside that is integrated into the top of the upper casing and by virtue of a split in the sleeve.

19. The aquatic propulsion system of claim 18 wherein there are graduations for different sprocket teeth numbers or keys, notches, or mechanical indices, wherein alignment of such devices corresponds to the optimal position of the teeth number of a particular mounted sprocket.

20. The aquatic propulsion system of claim 1, wherein the propulsion drive system is disposed completely externally, including the driven sprocket, the propeller shaft, and the bottom idler means, wherein the drive frame comprises a lower casing and an upper casing, both casings being a rack or trunk wherein the chain drive is disposed externally.

21. The aquatic propulsion system of claim 20, wherein the drive frame supports all sprockets and idlers by lugs mounted on the rack or trunk whereby the whole system operates in a dry environment; wherein the propeller shaft is substantially long, disposed generally beneath the pedal axle assembly, and providing for water entry at a gradual angle or at a substantial distance away from the pedal axle assembly through a seal in a large open hull, wherein said long shaft of the propeller is supported by a shaft keeper means including bushings, and wherein said shaft keeper is mounted at the bottom of the trunk or rack.

* * * * *